US005624204A

United States Patent [19]

Dorsemaine

[11] Patent Number: 5,624,204

[45] Date of Patent: Apr. 29, 1997

[54] WATER-RETENTION RESERVOIR STRUCTURE

[75] Inventor: Jean-Pierre Dorsemaine, Vendome, France

[73] Assignee: Hamon Industrie Thermique, Paris, France

[21] Appl. No.: 211,561

[22] PCT Filed: Oct. 7, 1992

[86] PCT No.: PCT/FR92/00930

§ 371 Date: Jun. 8, 1994

§ 102(e) Date: Jun. 8, 1994

[87] PCT Pub. No.: WO93/07345

PCT Pub. Date: Apr. 15, 1993

[30] Foreign Application Priority Data

Oct. 11, 1991 [FR] France ..... 91 12573

[51] Int. Cl.[6] ..... E02B 11/00; E02B 13/00

[52] U.S. Cl. ..... 405/52; 52/169.5; 52/169.14; 405/36; 405/43; 405/45

[58] Field of Search ..... 405/43, 45; 52/169.14, 52/169.5

[56] References Cited

U.S. PATENT DOCUMENTS

| | | | |
|---|---|---|---|
| 142,413 | 9/1873 | Pugh | 405/43 |
| 3,060,693 | 10/1962 | Taylor | 405/43 |
| 3,563,038 | 2/1971 | Healy et al. | 405/45 |
| 3,654,765 | 4/1972 | Healy et al. | 405/45 |
| 4,622,138 | 11/1986 | Wager | 405/45 |
| 4,745,716 | 5/1988 | Kuypers | 405/45 X |
| 4,749,306 | 6/1988 | Demeny et al. | 405/45 |
| 4,820,080 | 4/1989 | Varkonyi et al. | 405/45 |
| 4,880,333 | 11/1989 | Glasser et al. | 405/45 X |
| 4,917,536 | 4/1990 | Glasser . | |
| 4,943,185 | 7/1990 | McGuckin et al. | 405/45 |

FOREIGN PATENT DOCUMENTS

| | | |
|---|---|---|
| 2521374 | 12/1976 | Germany . |
| WO8802422 | 4/1988 | WIPO . |
| WO8909857 | 10/1989 | WIPO . |

*Primary Examiner*—Dennis L. Taylor
*Attorney, Agent, or Firm*—Sughrue, Mion, Zinn, Macpeak & Seas

[57] ABSTRACT

A structure having at least one layer (3.1), for example three layers (3.1, 3.2, 3.3), of a number of juxtaposed sheet blocks, in which the sheets are shaped so as to define between themselves a series of vertical cells for water storage, and a series of horizontal cells in the height of the blocks for water drainage. The horizontal cells communicate with the vertical cells. The structure is light, inexpensive, easy to install without requiring heavy handling means, and is especially useful in underground water reservoirs.

9 Claims, 4 Drawing Sheets

WATER-RETENTION RESERVOIR STRUCTURE

BACKGROUND OF THE INVENTION

The subject of the present invention is a block of juxtaposed sheets and a water-retention reservoir structure formed by a set of these blocks and intended for various uses, for example as a buried tank for retaining rainwater during very heavy rain, this structure then being connected to a water inlet and outlet collector system.

As is known, the continuous development of urban conglomerations results in an increase in areas of impermeable ground. In particular, car parks (for shopping centres, airports, leisure parks, etc.) and urban roadways are generally impermeable areas or nearly so, from which rainwater rapidly runs off towards the drainage systems. This impermeability prevents direct infiltration of rainwater. The result is that, during very heavy downpours, such as those which happen during storms, collectors designed for relatively low flow rates may be saturated and flooding in urban areas may occur.

Another consequence of this overloading of the water drainage systems (case of combined sewerage) is the direct discharge of polluted water into the receiving watercourse through the storm-water overflows, which may have particularly disastrous effects on the ecosystem.

When the inadequacy is limited to certain sections of the system, reinforcements are possible, but when it is the entire system which approaches saturation, it is necessary to find novel solutions, the reinforcement of one section possibly leading to a downstream spill-over. In order to face up to these problems, it is necessary either to delay considerably the flow-away (several hours being sometimes necessary), or to prevent any flow (by infiltration of the rainwater, for example), or even to combine these two solutions. This is possible by means of a temporary retention of the rainwater by retention tanks in the form of underground reservoirs.

Constructions, such as car parks, roadways, sports grounds, etc., integrating the storage of rainwater in a porous material into their structure, form part of these solutions and are called "reservoir structures". In this case, the porous material possesses at least two, hydraulic and mechanical, functions, and is generally located beneath the level of the natural terrain. This enables the surface water to be easily collected therein.

A buried water-retention reservoir structure is thus known from WO-A-88/00422, in which the upper part is constituted by a structure having mutually parallel vertical cells, resting on a lower part for horizontal drainage of the water, this lower part being formed, for example, by a gravel/sand mixture or by a porous material.

Such a reservoir structure takes a long time to install and furthermore requires heavy implementation means, so that it is very expensive to realize. In addition, its lower drainage structure may, after a certain time, be blocked by the accumulation of sand entrained by the water, and thereby render the entire structure inoperational.

SUMMARY OF THE INVENTION

The object of the invention is to propose a reservoir structure which is simple and rapid to put into place, the cost of which is therefore considerably reduced compared to that of the above known structure, and which cannot be blocked by sand or debris.

In accordance with the invention, the block of juxtaposed identical sheets, which is intended for a water-retention reservoir structure, is characterized in that the sheets are profiled so as to delimit between them a set of longitudinal cells or channels and of transverse cells or channels which establish communication between the longitudinal cells, the latter being open at their opposite ends.

In such a block, arranged so that the longitudinal cells extend vertically, the water may penetrate via the horizontal cells and then progressively fill the vertical cells.

The reservoir structure according to the invention comprises at least one layer of such juxtaposed blocks which are arranged so that the longitudinal cells extend vertically for the storage of the water, and so that the transverse cells extend horizontally for the horizontal circulation of the water between inlet and outlet collectors.

The horizontal cells are distributed over the greater part of the length of the vertical cells, that is to say of the blocks, and ensure drainage of the water virtually from the top down to the bottom of the blocks, whereas the vertical storage cells ensure the mechanical integrity of the assembly.

The fact that this structure is combined in order to fulfil simultaneously the functions of draining and storing the water, and then of vertical run-off of the water, considerably reduces the labour required, as well as the cost of the structure itself. It is advantageously made of a suitable plastic, such as, for example, polystyrene, polypropylene or polyvinyl chloride, or any other thermoplastic. These cellular blocks are particularly lightweight, while at the same time having a mechanical strength which may be adjusted to the requirements, which therefore saves on the heavy and expensive handling means which are required up to now in order to put the lower drainage layer into place.

Other features and advantages of the invention will appear during the description which follows, given with reference to the appended drawings which illustrate, by way of non-limiting example, one embodiment thereof.

DESCRIPTION OF A PREFERRED EMBODIMENT

Figure 1:
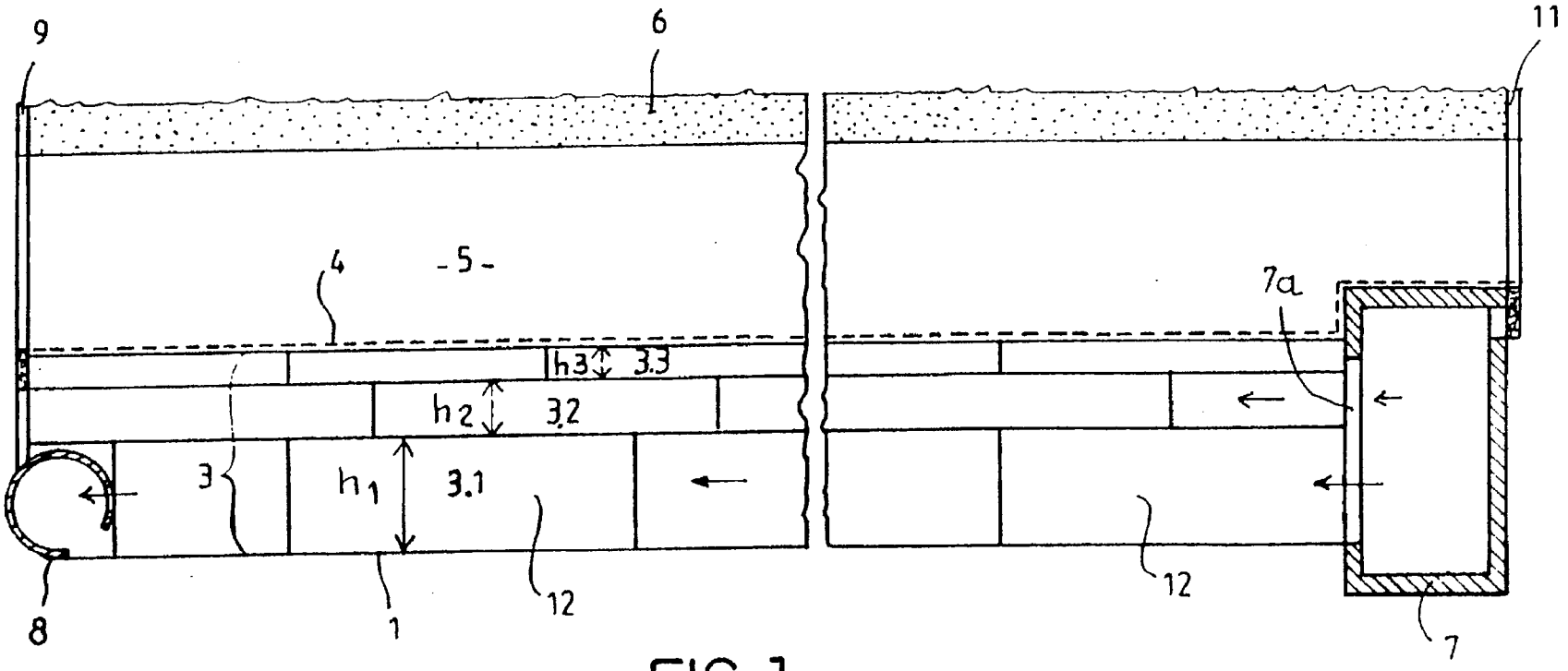
FIG. 1 is a diagrammatic view in elevation of an embodiment of the reservoir structure according to the invention, in which this structure forms part of an underground water-retention tank.

The water-retention reservoir structure shown in FIG. 1 comprises, from the bottom up, the following elements:

an impermeable membrane 1, a cellular part 3 formed by three superimposed layers 3.1, 3.2 and 3.3, a geotextile 4, a layer of fill 5 (or rubble used as fill) and, finally, a surface layer 6 of topsoil.

The cellular structure (3) communicates laterally with inlet 7 and outlet 8 collectors for the water accumulated in this structure, at the ends of which there are provided vertical vent pipes 9, 11 which emerge in the peripheral zone of the reservoir into the collectors 7 and 8.

The wall 7*a* of the collector 7 contiguous with the vertical terminal face of the structure 3 is perforated over virtually its entire height, whereas the outlet collector 8 is pierced with openings level with the lower part of the structure 3.

Figure 2:
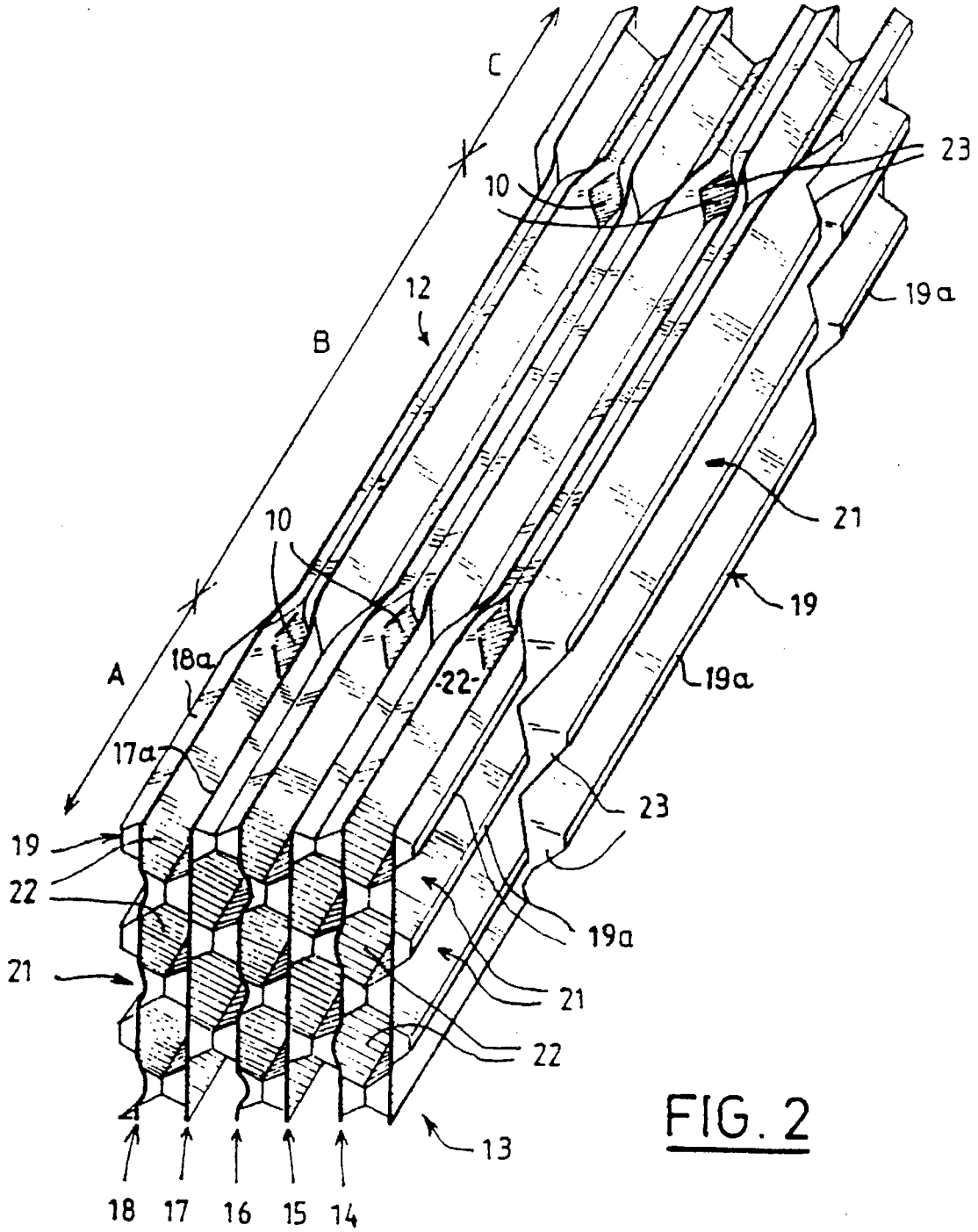
FIG. 2 is a view, in perspective, of a constituent block of the cellular structure according to the invention.
Figure 3:
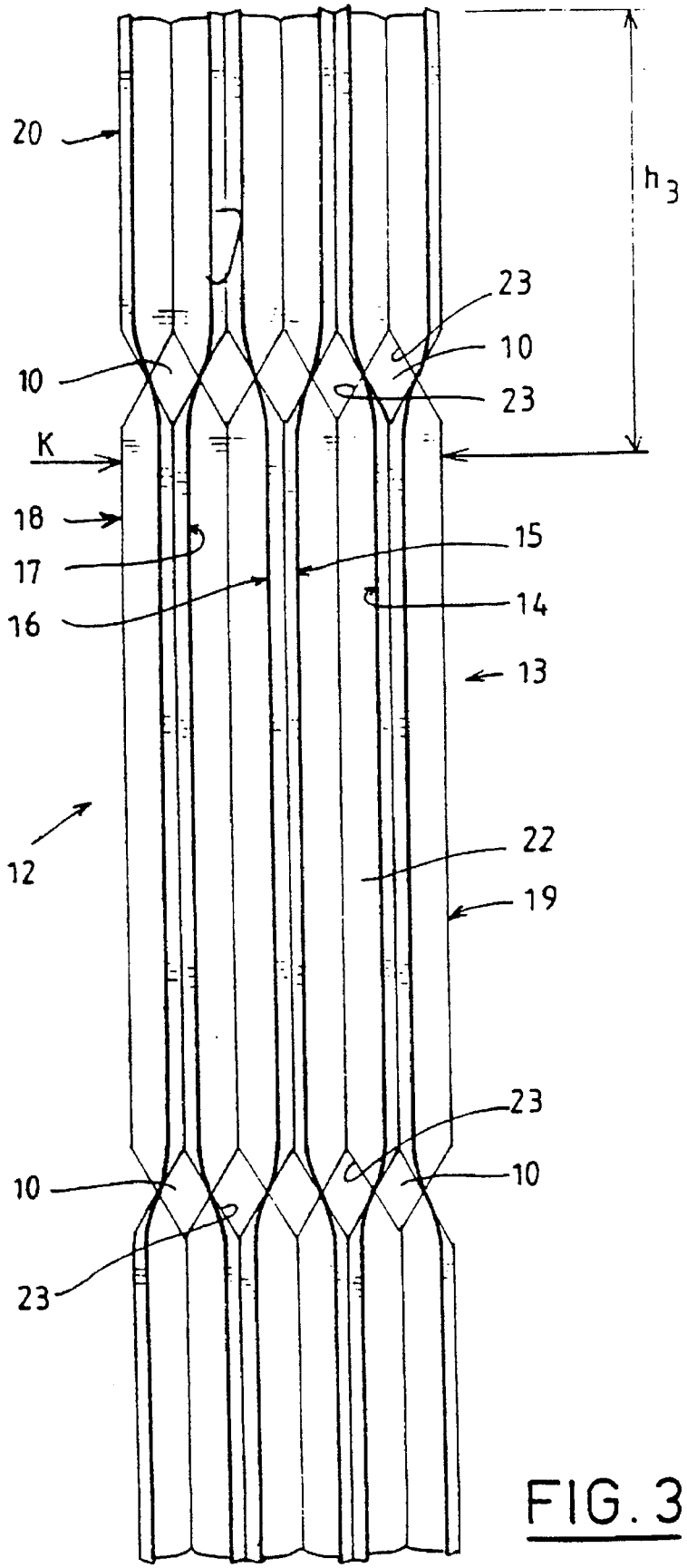
FIG. 3 is a view, in elevation, of the cellular-structure element of FIG. 2.
Figure 4:
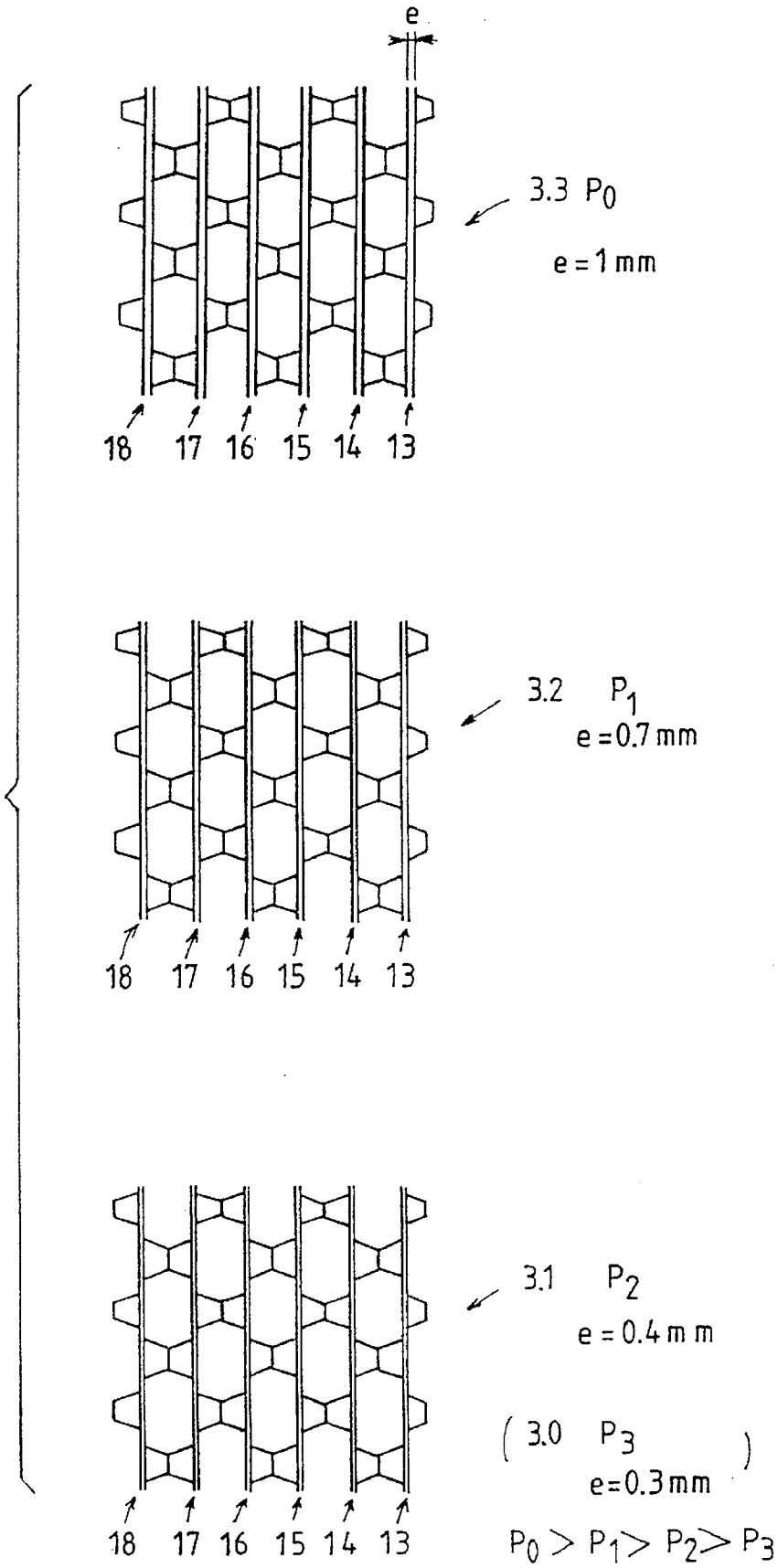
FIG. 4 illustrates the decreasing thickness of the sheets of the layers of FIG. 2, in the direction from the upper layer to the lower layer.

The structure 3 consists of a set of blocks 12 having juxtaposed cells or channels (FIGS. 2 and 3). Each element or block 12 is formed by joining together a series of identical sheets 13 . . . 18 which are suitably profiled so as to present a succession of straight projections 19 and of straight recesses 21 delimited by two consecutive projections 19. These recesses or grooves 21 and the projections 19 are alternated in the two transverse and longitudinal directions so as to be arranged in a staggered fashion. Thus, in the same longitudinal direction a projection 19 is located between two recesses 21, likewise in the transverse direction. Inclined flats 23 form the transition zones between the projections 19 and the recesses 21.

The tops of the projections 19 form straight flats 19*a* alternating on each side of the mid-plane of the sheet 13, . . . 18.

Two sheets are joined together by the welding or adhesive bonding of their projections 19 facing each other by their flats 19*a*, delimiting between them these projections 19 and the recesses 21 of the longitudinal cells or channels 22.

The succession of the flats 23 of two adjoined sheets delimit between these two sheets transverse cells or channels 10 which are perpendicular to the longitudinal cells 22 and the cross-section of which is diamond-shaped. These cells 10 communicate with the successive cells 22, which are thus connected together and the opposite, open, ends of which form the terminal faces of the block 12.

The lengths of the successive zones thus produced, arranged in a staggered fashion, may be variable, as may the number of successive zones for any one element 12.

In the example illustrated in the drawings, each sheet 13, etc. of a block 12 of sheets 13–18 includes three longitudinal zones A, B, C in which the projections 19 and the recesses 21 are alternated in a staggered fashion, the central zone B being substantially twice the length of that of each of the two end zones A and C. These zones are separated by parallel rows of transverse cells 10. On two opposite faces of a block 12, the edges of the sheets delimit between them cells 22 which are open longitudinally (FIG. 2) in the zones A and C by reason of the separation of these edges (for example 17*a* and 18*a*). On the other hand, in the central zone B, these edges are adjoined and therefore separate the open cells of the zones A and C.

The number of cells 10 may be increased in order to further the drainage function compared to the water-retention storage function, the outermost cells 10 then being close to the opposite ends of the blocks 12.

A set of blocks 12 suitably juxtaposed and placed so that their longitudinal cells 22 are vertical, bearing on one of their terminal faces, may therefore form a reservoir structure.

In the example shown in FIG. 1, this structure is produced in three superposed layers: a first layer 3.1 of a height h1, equal, for example, to that (A+B+C) of an element 12; then, arranged on the first layer 3.1, a second layer 3.2 of height h2 less than that of h1 of the first layer 3.1. The second layer 3.2 is obtained by cutting off a series of blocks 12, identical to those of the first layer 3.1 and of the lower structure 2, below its upper cells 10 to a level K (FIG. 3) close to the latter. Thus, the height h2 is slightly less than A+B. Finally, the third layer 3.3, placed so as to bear on the intermediate layer 3.2, is constituted by the juxtaposition of a set of truncated elements 20 which constitute the cut-off upper ends above the level K of the elements 12 and which are turned over through 180°. The result is that the cells 10 of the truncated elements 20 lie just below the upper surface of the structure 3.

The water-retention reservoir structure which has just been described, being buried and connected to a water drainage system as shown in FIG. 1, its technical effect is as follows.

Rainwater arrives into the collectol 7 via means not shown, known per se. From there, it penetrates into the structure 3 via the ends of the horizontal cells 10 and then progressively fills the vertical cells 22 which thus store the accumulated water. This water is subsequently drained into the collector 8 via the lower cells 10. The circulation of the water is symbolized by the arrows in FIG. 1.

It should be noted that, as a variant, the inlet collector 7 may be located at a place other than lateral to the reservoir structure 3, for example in a central zone of the latter. In this case, the second wall of the collector 7 is, of course, suitably perforated, like the wall 7*a*, and a second associated outlet collector 8 is necessary.

Over and above its technical advantages already mentioned, this reservoir structure has the following:

It advantageously prevents the trapping of air as the water level progressively rises inside the said structure. In fact, the air progressively forced into the part not filled by the water is drained via the horizontal cells 10 towards the vents 9 and 11, via which it is discharged into the atmosphere. In the absence of the horizontal cells 10, in the upper part 3, and of the vents 9, 11 the air would be progressively compressed by the rise in the water and would cause lifting of the rubble 5 and of the surface layer 6.

The horizontal cells 10 accelerate the filling of the reservoir by virtue of the communication which they establish between the vertical cells 22.

The drainage of the water is ensured over almost the entire height of the structure 3, by virtue of elimination of the conventional lower draining structure. Thus the thickness of this draining structure, and therefore the corresponding earthworks, are thus eliminated.

The sheets 13, 14, etc., produced by thermoforming a plastic, which may have a variable thickness, for example 1 mm, which makes it possible to adjust better their mechanical strength (an advantage which cannot be obtained with structures manufactured by extrusion). In fact, a mass laid on the ground above the reservoir structure 3 exerts, on the successive layers 3.3, 3.2, 3.1, pressures which decrease from the top down. The result is that the mechanical strength of the various layers may be adjusted to the pressures experienced. Thus this thickness of the sheets of the upper layer 3.3 will be greater than that of the intermediate layer 3.2, which itself will be greater than that of the lower layer 3.1. This thickness reduction lightens the assembly and therefore makes it easier to lay.

The height of the lowest horizontal cells 10 may advantageously be relatively high. In fact, this then enables the sand entrained by the water to be collected in the lower ends of the vertical cells 22. This sand cannot block up the lowest horizontal cells 10, contrary to the known draining structures, so that the drainage function is always ensured, despite the sand accumulated.

The example of the structure (2.3) of FIG. 1 is not limiting, it being possible for the vertical structure 3 to consist of a single layer formed by elements (such as 12, for example) of suitable height, or of several sublayers of identical or different heights.

Other embodiment variants may be provided. Thus, depending on the number and the size of the sheets (13, etc.), the corresponding parallelepipedal blocks 12 may have variable dimensions appropriate to each use envisaged.

On the other hand, these parallelepipedal blocks may be used so as to bear on any one of their faces, while still having horizontal drainage cells and vertical other ones for storage.

It is also possible, in at least part of the blocks 12, to orient every other sheet with its projections 19 perpendicular to the projections of the two contiguous sheets to which it is fixed. This arrangement improves the drainage function.

The sheets may also, in whole or in part, be perforated in order to increase the effectiveness of the drainage.

The reservoir structure according to the invention is capable of numerous applications, among which the following may be mentioned:

Use for lightening the fill in soft ground, the structure being able to be used as a replacement for all or part of a fill, thereby enabling the settlement of soft ground to be effectively reduced. This technique is particularly suitable in the vicinity of construction works having foundations on piles or in the compressible soil/rocky substratum transition zones. It stops the continuation of unacceptable settlement in an economical way.

Use as a buried reservoir for the retention of rainwater, especially the particularly abundant water called "decade water". This use, illustrated in FIG. 1, enables the water to be stored in the structure 2, 3, and then the water thus collected is drained with flow rates compatible with the existing drainage system (collectors 7, 8).

Use of the structure as a porous roadway: after direct infiltration through the roadway layers (draining coated chippings and draining gravel/sand mixture), the water is stored in the reservoir structure according to the invention, and then recovered either by infiltration into the ground or via a conduit into the drainage system.

What is claimed is:

1. A rigid, non-flexible water-retention and -drainage reservoir block (12), of directly joined juxtaposed identical sheets, without separation therebetween, for use in a water-retention and -drainage reservoir structure (3) having a water inlet (7) and a water outlet (8), wherein each sheet has transversely opposite faces extending longitudinally and transversely, wherein said sheets are joined face-to-face, and wherein said identical sheets are shaped so as to define between them a set of straight longitudinal cells (22), which form a reservoir for storing water, and straight transverse cells (10) which establish water flow paths between the longitudinal cells, the longitudinal cells being open at opposite ends thereof.

2. A water retention reservoir structure, wherein:

it comprises at least one layer (3.1) of juxtaposed blocks (12), each block comprising a plurality of juxtaposed identical sheets which are shaped so as to define between them a set of straight longitudinal cells (22) and straight transverse cells (10) which establish flow paths between the longitudinal cells, the longitudinal cells being open at opposite ends thereof, said blocks arranged so that the straight longitudinal cells (22) extend vertically for storage of water, and wherein the straight transverse cells (10) extend horizontally for horizontal circulation of the water between inlet (7) and outlet (8) collectors;

each block (12) is constituted by joining together said identical sheets which are shaped so that each sheet has a succession of straight projections (19) and straight recesses (23) alternating in the transverse and longitudinal directions, each sheet being fixed by its projections to two contiguous sheets, thereby defining between the projections the horizontal (10) and vertical (22) cells; and in at least part of the blocks (12), every other one of said sheets is oriented so that its projections (19) are perpendicular to the projections (19) of the contiguous sheets to which said other sheet is fixed.

3. A water-retention reservoir structure, wherein it comprises at least one layer (3.1) of rigid, non-flexible juxtaposed blocks (12), each block comprising a plurality of directly joined juxtaposed identical sheets, without separation therebetween, each of which has transversely opposite faces extending longitudinally and transversely, which sheets are formed face-to-face, and which sheets are shaped so as to define between them a set of straight longitudinal cells (22), which form a reservoir for storage of water, and straight transverse cells (10) which establish flow paths between the longitudinal cells, the longitudinal cells being open at opposite ends thereof, said blocks being arranged so that the straight longitudinal cells (22) extend vertically for said storage of water, and wherein the straight transverse cells (10) extend horizontally for horizontal circulation of the water between inlet (7) and outlet (8) collectors.

4. The structure according to claim 3, characterized in that the transverse horizontal cells (10) pass through the vertical longitudinal cells (22) and extend over a major part of a length of the longitudinal vertical cells.

5. The structure according to claim 2 or 4, characterized in that it includes a lower first layer (3.1) of a defined height (h1), a second layer (3.2) of a height (h2) less than that of the first, obtained by cutting off a structure (12) identical to that of the first layer (3.1) below upper horizontal one of said cells (10), and an upper third layer (3.3) constituted by the turning-over through 180 degrees of a remaining part (20) of the cut-off structure (12), in such a way that an upper row of horizontal cells (10) is close to an upper face of the said third layer (3.3).

6. The structure according to claim 3, characterized in that each block (12) is constituted by joining together said identical sheets which are shaped so that each has a succession of straight projections (19) and straight recesses (23) alternating in the transverse and longitudinal directions, each sheet being fixed by its projections to two contiguous sheets, thereby delimiting between the projections the horizontal (10) and vertical (22) cells.

7. The structure according to claim 5, wherein said first, second and third layers are superposed layers, wherein the sheets constituting each layer have a thickness which decreases from the upper layer (3.3) to the lower layer (3.1).

8. The structure according to claim 6, characterized in that, in at least part of the blocks (12), every other one of said sheets is oriented so that its projections (19) are perpendicular to the projections (19) of the contiguous sheets to which said other sheet is fixed.

9. The structure according to claim 8, characterized in that perforations are made in at least one part of the sheets.

* * * * *